US005547798A

United States Patent [19]

Suzuki et al.

[11] Patent Number: 5,547,798

[45] Date of Patent: Aug. 20, 1996

[54] TONER COMPOSITION AND TONER WITH LOW AND HIGH M.W. VINYL POLYMERS

[75] Inventors: Tatsuo Suzuki; Susumu Tanaka, both of Shiga; Takashi Ueyama, Kusatsu, all of Japan

[73] Assignee: Sekisui Chemical Co., Ltd., Osaka, Japan

[21] Appl. No.: 338,873

[22] Filed: Nov. 14, 1994

[30] Foreign Application Priority Data

Nov. 19, 1993 [JP] Japan ..... 5-290373

[51] Int. Cl.$^6$ ..... G03G 9/087

[52] U.S. Cl. ..... 430/109; 430/111; 525/302

[58] Field of Search ..... 430/109, 111; 525/302

[56] References Cited

U.S. PATENT DOCUMENTS

| | | | |
|---|---|---|---|
| 5,264,311 | 11/1993 | Nakano et al. | 430/109 |
| 5,415,965 | 5/1995 | Tsuda et al. | 430/109 |
| 5,422,217 | 6/1995 | Ueyama et al. | 430/109 |

FOREIGN PATENT DOCUMENTS

| | | |
|---|---|---|
| 56-16144 | 2/1981 | Japan . |
| 56-158340 | 12/1981 | Japan . |
| 58-202455 | 11/1983 | Japan . |

*Primary Examiner*—Roland Martin
*Attorney, Agent, or Firm*—Townsend & Banta

[57] ABSTRACT

To provide a toner resin composition and toner which has superior anti-offset properties, low temperature fixability and anti-blocking properties, and gives sufficiently stable high-quality images even when copying is done over a long duration of time. This toner resin composition is a toner resin composition comprising a low molecular weight vinyl polymer component and a high molecular weight vinyl polymer component which comprising styrene-type monomers and (meth)acrylic esters as structural units of said polymer components and having peaks of the molecular weight distribution in the region of molecular weights from about $4\times10^3$ to about $8\times10^4$ and in the region of molecular weights from about $1\times10^5$ to about $4\times10^6$, wherein said high molecular weight vinyl polymer component contains about 97 wt % or more of styrene-type monomers as structural units for said polymer component, and a styrene polymer with a weight average molecular weight of about 300,000 or higher, or a gel content of about 20 wt % or higher makes up 50 wt % or more of it. The target toner is obtained by using this toner resin composition.

3 Claims, No Drawings

TONER COMPOSITION AND TONER WITH LOW AND HIGH M.W. VINYL POLYMERS

FIELD OF THE INVENTION

This invention relates in general to a toner resin composition and toner used in electrophotography and such, and more precisely to a toner resin composition and toner which are used for the dry developing method in the electrostatic charge image development method.

RELATED PRIOR ART

In electrophotography, the dry developing method is often used to develop electrostatic charge images. In the dry developing method, toner (developing agent) capable of frictional electrification is used, said toner being a mixture of fine powder comprising coloring agents such as carbon black and other additives added to a toner resin which serves as a binder, as well as a carrier such as iron powder and glass beads.

A copy is usually obtained by forming an electrostatic latent image on a photosensitive matter, developing this electrostatic latent image by adhering toner capable of frictional electrification to it, transferring the toner image thus obtained to a sheet such as a piece of paper, and fixing it by using a heat-press roller(s) made of a toner-separating material to obtain a permanent visible image.

For this type of toner, those with superior anti-offset properties (that is, the toner does not stick to the heat-press roller(s) for fixing and stain the paper), low temperature fixability (the toner adheres firmly to the paper at low temperatures), anti-blocking properties (toner particles do not aggregate) and image stability (the amount of charge does not vary and the image density is uniform) are required.

Toner which is known to have improved anti-offset properties, low temperature fixability and anti-blocking properties uses for a binder resin a resin composition comprising a low molecular weight vinyl polymer component and a high molecular weight vinyl polymer component which contains styrene-type monomers and (meth)acrylic esters as the structural units of said polymer components and has peaks of the molecular weight distribution in the region of molecular weights from $1\times10^3$ to $8\times10^4$ and in the region of molecular weights from $1\times10^5$ to $2\times10^6$ (for example, see Japanese unexamined patent publication (Tokkai) Sho 56-16144).

The conventional toners such as described above usually contain an electrification control agent. For the electrification control agent, dyes such as Nigrosine and Spiron Black (from Hodogaya Kagaku) and/or phthalocyanine pigments are known and generally used.

The conventional toners such as described above had good anti-offset properties, low temperature fixability and anti-blocking properties and nicely maintained a certain level of electrification control capability and image stability in a fluctuating environment. However, the aforementioned performance was not satisfactory when copying was done over a long duration of time with the toner in the copier and/or when images with higher quality were desired.

SUMMARY OF THE INVENTION

The present invention is meant to solve these problems with conventional toners and its object is to provide a toner resin composition and toner which has superior anti-offset properties, low temperature fixability and anti-blocking properties, and gives sufficiently stable high-quality images even when copying is done over a long duration of time.

DETAILED DESCRIPTION OF THE INVENTION

The toner resin composition of the present invention is a toner resin composition comprising a low molecular weight vinyl polymer component and a high molecular weight vinyl polymer component which, as a whole, contains styrene-type monomers and (meth)acrylic esters as structural units of said polymer components and has peaks of the molecular weight distribution in the region of molecular weights from about $4\times10^3$ to $8\times10^4$ and in the region of molecular weights from about $1\times10^5$ to $4\times10^6$, characterized by the fact that said high molecular weight vinyl polymer component contains about 97 wt % or more of styrene-type othomers as structural units for said polymer component, and that a styrene polymer having a weight average molecular weight of about 300,000, or higher or a gel content of about 20 wt % or higher makes up about 50 wt % or more of it.

The toner according to the present invention is characterized in that it uses the toner resin composition described above.

The present invention, as described above, uses a toner resin composition comprising a low molecular weight vinyl polymer component and a high molecular weight vinyl polymer component which, as a whole, contains styrene-type monomers and (meth)acrylic esters as structural units of said polymer components.

Specific examples of the styrene-type monomers are: styrene, o-methylstyrene, m-methylstyrene, p-methylstyrene, alpha-methylstyrene, p-ethylstyrene, 2,4-dimethylstyrene, p-n-butylstyrene, p-t-butylstyrene, p-n-hexylstyrene, p-n-octylstyrene, p-n-dodecylstyrene, p-methoxystyrene, p-phenylstyrene, p-chlorostyrene, 3,4-dichlorostyrene and divinylbenzene.

Specific examples of the (meth)acrylic ester monomers are: alkyl esters of (meth)acrylic acid, such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, methyl methacrylate, ethyl methacrylate, propyl methacrylate, n-butyl methacrylate, isobutyl methacrylate, n-octyl methacrylate, dodecyl methacrylate and stearyl methacrylate.

Additional examples include 2-chloroethyl acrylate, phenyl acrylate, methyl alpha-chloro acrylate, phenyl methacrylate, dimethylaminoethyl methacrylate, diethylaminoethyl methacrylate, 2-hydroxyethyl methacrylate, glycidyl methacrylate, bisglycidyl methacrylate, polyethyleneglycol dimethacrylate and methacryloxyethyl phosphate.

More preferable are ethyl acrylate, propyl acrylate, butyl acrylate, methyl methacrylate, ethyl methacrylate, propyl methacrylate and butyl methacrylate.

In addition to the styrene-type monomers and (meth-)acrylic ester monomers described above, other vinyl monomers can be used as structural units of the vinyl polymer components. Examples of these vinyl type monomers are: acrylic acid and its alpha- or beta-alkyl derivatives such as acrylic acid, methacrylic acid, alpha-ethyl acrylic acid and crotonic acid; unsaturated dicarboxylic acids as well as their mono ester derivatives and diester derivatives such as fumaric acid, maleic acid, citraconic acid and itaconic acid; and also monoacryloyloxyethylester succinate, monomethacryloyloxyethylester succinate, acrylonitrile, methacrylonitrile and acrylamide, vinyl acetate, vinyl chloride and ethylene.

Specific examples of the vinyl polymer components described above follow. For example, for the low molecular weight vinyl polymer component, a (meth)acrylic ester homopolymer or copolymer of styrene-type monomers and (meth)acrylic ester is used, and, for the high molecular weight vinyl polymer component, a homopolymer of styrene-type monomers or copolymer of styrene-type monomers and (meth)acrylic ester. In this case, it is sufficient if the resin composition is formed in such a way that the low molecular weight vinyl polymer component and the high molecular weight vinyl polymer component described above, combined as a whole, have styrene-type monomers and (meth)acrylic esters as structural units of said polymer components.

In the resin composition described above, it is preferable to contain about 60–95 wt % of the styrene-type monomer component and about 5–40 wt % of the (meth)acrylic ester monomer component. If the content of the styrene-type monomer component is lower, then the anti-blocking properties of the toner tend to decrease. On the other hand, if the content of the styrene-type monomer is higher, then the fixability of the toner tends to decrease.

Furthermore, in this invention, the resin composition as described above which has peaks of the molecular weight distribution in the region of molecular weights from about $4\times10^3$ to about $8\times10^4$ and in the region of molecular weights from about $1\times10^5$ to about $4\times10^6$ is used. This molecular weight distribution is determined by gel permeation chromatography (GPC) in which monodisperse polystyrene standard samples are used. It is sufficient if this resin composition has at least one peak in each of the molecular weight regions specified above. There can be two or more peaks in each of the molecular weight regions specified above.

In the molecular weight distribution of the resin composition described above, the peak in the region of molecular weights from about $4\times10^3$ to about $8\times10^4$ comes from said low molecular weight vinyl polymer, and the peak in the region of molecular weights from about $1\times10^5$ to about $4\times10^6$ comes from said high molecular weight vinyl polymer. If the peak molecular weight originating from the low molecular weight vinyl polymer is lower than the range specified above, then toner particles tend to aggregate. On the other hand, if it is greater than the range specified above, then the low temperature fixability will be reduced. If the peak molecular weight originating from the high molecular weight vinyl polymer is lower than the range specified above, then the anti-offset properties will deteriorate. On the other hand, if it is greater than the range specified above, then the low temperature fixability will be reduced.

For the ratio between the low molecular weight vinyl polymer component and the high molecular weight vinyl polymer component, it is preferable to have about 90–50 wt % of the low molecular weight vinyl polymer and about 10–50 wt % of the high molecular weight vinyl polymer. If the content of the high molecular weight vinyl polymer is lower, then the anti-offset properties tend to decrease. On the other hand, if the content of the high molecular weight vinyl polymer is higher, then the low temperature fixability tends to decrease. In order to control aggregation of the toner particles, it is preferable that the resin composition described above has a glass transition point of about 50° C. or higher, as measured by a differential scanning calorimeter (DSC).

In this invention it is also required that the high molecular weight vinyl polymer component of the resin composition described above comprises about 97 wt % or more of styrene-type monomers as structural units for said polymer component, and that a styrene polymer with a weight average molecular weight of about 300,000 or higher and a gel content of about 20 wt % higher makes up 50 wt % or more of it. Particularly preferable are those which comprise about 99 wt % or more of styrene-type monomers as structural units for said polymer component and about 80 wt % or more of which is made up of a styrene polymer with a weight average molecular weight of about 400,000, or higher or a gel content of about 30 wt % or higher.

The reasons for this follow: if the weight average molecular weight is lower than about 300,000 or the gel content (non-soluble to solvent) is less than 20 wt % for the styrene-type polymer in the vinyl polymer component described above, then sufficient anti-offset properties cannot be obtained. Also, if the content of the styrene-type monomers as structural units of the vinyl polymer described above is less than 97 wt % or if the content of the styrene-type polymer in the vinyl polymer component is less than 50 wt %, then high quality images cannot be obtained and stable images cannot be obtained over a long duration of time.

The weight average molecular weight described above is measured by means of gel permeation chromatography (GPC). The gel content (non-soluble to solvent) is measured using tetrahydrofuran solvent.

Such a resin composition is prepared by methods including: (1) a method in which the high molecular weight vinyl polymer component and the low molecular weight vinyl polymer component are melt-kneaded, (2) a method in which the high molecular weight vinyl polymer component and the low molecular weight vinyl polymer component are mixed and dissolved in an organic solvent, (3) a method in which the high molecular weight vinyl polymer component is dissolved in an organic solvent, the vinyl monomers which give the low molecular weight vinyl polymer component are dissolved, and these monomers are polymerized, and (4) a method in which a part or all of the vinyl monomers are polymerized to produce the high molecular weight vinyl polymer component which is then dissolved in an organic solvent, and the vinyl monomers which give the low molecular weight vinyl polymer component are added to it, followed by polymerization of these monomers.

Methods (2) through (4) described above are particularly preferable for more uniform dispersion of the high molecular weight vinyl polymer component and the low molecular weight vinyl polymer component in the resin composition for better results. More preferable are methods (3) and (4) described above. For the resin composition described above, particularly preferable are those in which the high molecular weight vinyl polymer component has only styrene as the structural unit of said polymer component or styrene and (meth)acrylic ester as the structural units of said polymer component and the low molecular weight vinyl polymer component has styrene and (meth)acrylic esters as the structural units of said polymer.

The resin composition according to the present invention is thus obtained and this resin composition is used as a binder resin for toner. In advance, conventional toner additives such as a coloring agent(s) and an electrification control agent may also be blended into the toner resin composition of this invention.

The method adopted to prepare the toner of this invention using the toner resin composition described above comprises, for example: blending conventional toner additives such as a coloring agent(s) and an electrification control agent into the toner resin composition obtained by the method described above, kneading the mixture with a roll-mill, kneader or extruder, and cooling and crushing it into fine particles. If the toner additives such as a coloring agent(s) and an electrification control agent are blended in advance in the toner resin composition described above, then these toner additives are not required.

For the coloring agent described above, pigments or dyes conventionally used for this type of toner including carbon black, chrome yellow and aniline blue are used. For the electrification control agent, dyes such as Nigrosine and Spiron Black (from Hodogaya Kagaku) and phthalocyanine pigments are used. Agents which facilitate separation from the fixing roller of the copier, such as polypropylene wax and low molecular weight polyethylene, can also be blended in. In addition, aliphatic amides, bisaliphatic amides, metal soaps, paraffin, etc. can also be added.

It is also possible to add hydrophobic silica and such to increase the flowability of the toner particles. Magnetic powder composed of ferromagnetic alloys or compounds of iron, zinc, cobalt, nickel, manganese, etc., such as magnetite, ferrite and hematite, can also be blended to obtain magnetic toner.

As necessary, small amount of prior art binder resins other than vinyl polymers, such as polyester resins and epoxy resins can be blended into the toner resin composition and the toner.

A toner primarily superior in anti-offset properties, low temperature fixability and anti-blocking properties can be obtained by using as a binder resin a toner resin composition comprising a low molecular weight vinyl polymer component and a high molecular weight vinyl polymer component which, as a whole, contains styrene-type monomers and (meth)acrylic esters as structural units of said polymer components and has peaks of the molecular weight distribution in the region of molecular weights from about $4\times10^3$ to about $8\times10^4$ and in the region of molecular weights from about $1\times10^5$ to about $4\times10^6$, because of the actions of these low molecular weight and high molecular weight vinyl polymer components.

Furthermore, if said high molecular weight vinyl polymer component contains about 97 wt % or more of styrene-type monomers as structural units for said polymer component, and if styrene polymer with a weight average molecular weight of about 300,000 or higher or a gel content of about 20 wt % or higher makes up about 50 wt % or more of it, then, even when copying is done over a long duration of time, the amount of charge does not fluctuate and sufficiently stable high quality images with uniform image density can be obtained without deteriorating the features described above.

The reason for this is surmised as follows. That is, the inventors discovered that toner using the toner resin composition described above always contained a minute amount of vinyl monomers and that (meth)acrylic esters in particular compromised the image stability. It was also discovered that the electrical resistance of the high molecular weight vinyl polymer component significantly influenced the image.

Therefore, we surmise that by using more of a styrene-type monomer component, as described above, and less of a (meth)acrylic ester component for the high molecular weight vinyl polymer components, the electrical resistance of the high molecular weight vinyl polymer component increases because of the styrene-type monomer component and the influence of the (meth)acrylic ester is significantly reduced, thus the amount of toner charge is stabilized, resulting in sufficiently stable high quality images with uniform image density.

EXAMPLES

Examples and comparative examples of this invention are described below.

Example 1

900 g of toluene was put into a 3-liter separatable flask and 400 g of polystyrene with a weight average molecular weight of 500,000 and a styrene content of 99 wt % or more (polystyrene UHB-100, from Nippon Steel Chemical) was dissolved in it. After the gas phase was replaced by nitrogen gas, this system was heated to the boiling point of toluene. After the refluxing of toluene had begun, a dissolved mixture of 400 g of styrene, 100 g of 2-ethylhexyl acrylate and 15 g of azobisisobutyronitrile, as a polymerization starter, was dripped into the system over 6 hours with agitation, during which the solution polymerization took place.

After the completion of dripping, the system was aged for 6 hours with agitation at the boiling temperature of toluene. The system temperature was then gradually raised to 180° C., while toluene was removed under reduced pressure. The composition was cooled and crushed to obtain a toner resin composition. This toner resin composition had peak values in its molecular weight distribution at 10,000 and 400,000 and a glass transition temperature of 58° C.

100 weight parts of this toner resin composition, 5 weight parts of carbon black (from Mitsubishi Chemical Industries, Ltd., product name: MA-100), 1 weight part of Spiron Black TRH (from Hodogaya Chemicals) and 3 weight parts of polypropylene wax (from Sanyo Chemical Industries, Ltd., product name: Viscol 660P) were melt-blended with a roll-mill, cooled, coarsely crushed and then finely crushed with a jet-mill to obtain toner powder with an average particle size of approximately 13–15 micrometers.

Toner was prepared by adding 0.3 weight parts of hydrophobic silica powder (from Aerosil Japan, product name: R-972) to the toner powder thus obtained. 10 g of this toner was put into a 100 ml sample bottle, and let stand for 16 hours in a 50° C. thermostatic bath, followed by measurement of the degree of aggregation using a powder tester (from Hosokawa Micron, Ltd.). No aggregation of the toner particles was observed.

Four weight parts of this toner and 96 weight parts of iron powder carrier with an average particle size of approximately 50–80 micrometers were mixed to prepare a developing agent. Using this developing agent, the fixing temperature and offset occurring temperature were measured with the procedured described below.

The electrophotographic copier used was a Fuji Xerox 3500 from Fuji Xerox with some modifications so that the temperature of the fixing heat-press roller could be changed. Copies were made at various temperatures of the heat-press roller of the electrophotographic copier. Said copy images were then rubbed with a typewriter eraser (ER-502R, manufactured by LION) [a rubber eraser with fine abrasive particles in it, called a "sand eraser" in Japan and used for erasing letters typed in ink], and the temperature setting at which the density of the copy images changed after rubbing was defined as the fixing temperature. The fixing temperature of this toner was 140° C., which was sufficiently low.

The offset occurring temperature was defined as the temperature setting at which the offset phenomenon occurs when obtaining copies at various temperature settings of the heat-press roller of the electrophotographic copier. Due to the heat resistance limit of the roll, the temperature setting did not go higher than 200° C. for this testing. The offset occurring temperature of this toner was 200° C. or higher, which was sufficiently high.

Photographs were copied and images with a very high reproducibility were obtained. Fine lines were copied and images with a very high reproducibility and no blurs and such were obtained. Also, a running test of 20,000 copies was conducted. As a result, absolutely no compromised images were observed, and very stable and high quality images were obtained.

Example 2

1200 g of xylene was put into a 3-liter separatable flask and 200 g of polystyrene with a gel content of 40 wt % and a styrene content of 99 wt % or more, 20 g of a styrene-2-ethylhexyl acrylate copolymer with a weight average molecular weight of 1,000,000 comprising 80 wt % of styrene and 20 wt % of 2-ehtylhexyl acrylate and 500 g of styrene-n-butyl acrylate copolymer with a weight average molecular weight of 7,000 comprising 80 wt % of styrene and 20 wt % of n-butyl acrylate were dissolved in it.

After the gas phase was replaced by nitrogen gas, this system was heated to the boiling point of xylene. After the refluxing of xylene had begun, the system was agitated for 2 hours. The system temperature was then gradually raised to 180° C., while xylene was removed under reduced pressure. The composition was cooled and crushed to obtain a toner resin composition. This toner resin composition had peak values in its molecular weight distribution at 7,000 and 1,500,000 and a glass transition temperature of 60° C.

The rest of the procedure was done in the same manner as in Example 1 except for the fact that this toner resin composition was used. Again, no aggregation of the toner was observed. The fixing temperature was 140° C., and the offset occurring temperature was 200° C. and higher. Photographs were copied and images with a very high reproducibility were obtained. Fine lines were copied and images with a very high reproducibility and no blurs and such were obtained. Also, a running test of 20,000 copies was conducted. As a result, absolutely no compromised images were observed, and very stable and high quality images were obtained.

Example 3

18 weight parts of polystyrene with a weight average molecular weight of 1,500,000 and a styrene content of 99 wt % or more and 82 weight parts of styrene-n-butyl methacrylate-n-butyl acrylate copolymer with a styrene content of 70 wt %, an n-butyl methacrylate content of 20 wt % and an n-butyl acrylate content of 10 wt % were kneaded in a nitrogen-gas-substituted kneader for 10 minutes at 170° C. The resin obtained was cooled and crushed to obtain a toner resin composition. This toner resin composition had peak values in its molecular weight distribution at 20,000 and 1,000,000 and a glass transition temperature of 62° C. The rest of the procedure was done in the same manner as in Example 1 except for the fact that this toner resin composition was used.

Again, no aggregation of the toner was observed. The fixing temperature was 140° C., and the offset occurring temperature was 200° C. and higher. Photographs were copied and images with a very high reproducibility were obtained. Fine lines were copied and images with a very high reproducibility and no blurs and such were obtained. Also, a running test of 20,000 copies was conducted. As a result, absolutely no compromised images were observed, and very stable and high quality images were obtained.

Comparative Example 1

The procedure was the same as Example 1 except for the fact that 400 g of polystyrene with a weight average molecular weight of 200,000 and a styrene content of 99 wt % or more was used instead of 400 g of polystyrene with a weight average molecular weight of 500,000 and a styrene content 99 wt % or more. The toner resin composition obtained had peak values in its molecular weight distribution at 10,000 and 150,000 and a glass transition temperature of 58° C.

In this case, no aggregation of the toner was observed, and the fixing temperature was 140 ° C. However, the offset occurring temperature was 170° C., which was not sufficient. Photographs were copied and images with a very high reproducibility were obtained. Fine lines were copied and images with a very high reproducibility and no blurs and such were obtained. However, compromised images were observed in a running test of 10,000 copies.

Comparative Example 2

The procedure was the same as Example 1 except for the fact that 400 g of a styrene-n-butyl acrylate copolymer with a weight average molecular weight of 500,000, a styrene content of 80 wt % and an n-butyl acrylate content of 20 wt % was used instead of 400 g of polystyrene with a weight average molecular weight of 500,000 and a styrene content 99 wt % or more. The toner resin composition obtained had peak values in its molecular weight distribution at 10,000 and 400,000 and a glass transition temperature of 48° C.

In this case, the fixing temperature was 130° C. However, aggregation of the toner was observed, and the offset occurring temperature was 190° C. Photographs were copied and the obtained images did not show high enough -reproducibility. Fine lines were copied and the obtained images were blurry. Compromised images were observed in a running test of 4,000 copies.

Comparative Example 3

The procedure was the same as Example 1 except for the fact that 180 g of polystyrene with a weight average molecular weight of 500,000 and 220 g of a styrene-n-butyl acrylate copolymer with a weight average molecular weight of 500,000, a styrene content of 80 wt % and an n-butyl acrylate content of 20 wt % were used instead of 400 g of polystyrene with a weight average molecular weight of 500,000 and a styrene content 99 wt % or more. The toner resin composition obtained had peak values in its molecular weight distribution at 10,000 and 400,000 and a glass transition temperature of 52° C.

In this case, the fixing temperature was 140° C. and the offset occurring temperature was 200° C. Some aggregation of the toner was observed. Photographs were copied and the obtained images did not show high enough reproducibility. Fine lines were copied and the obtained images were blurry. Compromised images were observed in a running test of 8,000 copies.

Comparative Example 4

The procedure was the same as Example 1 except for the fact that 400 g of a styrene-n-butyl acrylate copolymer with a weight average molecular weight of 500,000 and a styrene content of 95 wt % and an n-butyl acrylate content of 5 wt % was used instead of 400 g of polystyrene with a weight average molecular weight of 500,000 and a styrene content 99 wt % or more. The toner resin composition obtained had peak values in its molecular weight distribution at 10,000 and 400,000 and a glass transition temperature of 57° C.

In this case, the fixing temperature was 140° C. and the offset occurring temperature was 200° C. No aggregation of the toner was observed. Photographs were copied and the obtained images did not show high enough reproducibility. Fine lines were copied and the obtained images were blurry. Compromised images were observed in a running test of 6,000 copies.

Comparative Example 5

The procedure was the same as Example 1 except for the fact that 400 g of polystyrene with a weight average molecular weight of 500,000 and a styrene content 99 wt % or more was not used. The toner resin composition obtained had a peak value in its molecular weight distribution at 10,000 and a glass transition temperature of 50° C.

In this case, the fixing temperature was 130° C. However, the offset occurring temperature was 130° C., which was inadequate, and some aggregation of the toner was observed. Photographs were copied and images with a relatively high reproducibility were obtained. Fine lines were copied and no blurs were observed. However, compromised images were observed in a running test of 1,000 copies.

Comparative Example 6

The procedure was the same as Example 1 except for the fact that only 400 g of polystyrene with a weight average molecular weight of 500,000 and a styrene content 99 wt % or more was used and that the subsequent solution polymerization using styrene and 2-ethylhexyl acrylate was omitted. The toner resin composition obtained had a peak value in its molecular weight distribution at 400,000 and a glass transition temperature of 100° C.

In this case, no aggregation of the toner was observed. However, the fixing temperature was 200° C. or higher, which was utterly inadequate. Photographs were copied and images with a relatively high reproducibility were obtained. Fine lines were copied and no blurs were observed. The running test could not be carried out due to the high fixing temperature.

Comparative Example 7

The procedure was the same as Example 2 except for the fact that, instead of 500 g of a styrene-n-butyl acrylate copolymer with a weight average molecular weight of 7,000, 500 g of a similarly prepared styrene-n-butyl acrylate copolymer with a weight average molecular weight of 2,000 was used. The toner resin composition obtained had peak values in its molecular weight distribution at 2,000 and 1,500,000, and a glass transition temperature of 47° C.

In this case, the fixing temperature was 130° C. However, aggregation of the toner was observed, and the offset occurring temperature was 190° C. Photographs were copied and images with a relatively high reproducibility were obtained. Fine lines were copied and no blurs were observed. However, compromised images were observed in a running test of 2,000 copies.

The toner resin composition of the present invention is configured as described thus far, and it has superior anti-offset properties, low temperature fixability and anti-blocking properties, and gives sufficiently stable high-quality images even when copying is done over a long duration of time, representing superior image stability.

Therefore, by using the toner resin composition and toner of the present invention, it is possible to sufficiently meet the requirements recently emerged, such as faster copying, less energy consumption, maintenance free operation, stable images and higher-quality images.

What is claimed is:

1. A toner resin composition comprising a low molecular weight vinyl polymer component and a high molecular weight vinyl polymer component having styrene containing monomers and (meth) acrylic esters as structural units of said polymer components and having peaks of molecular weight distribution in the region of molecular weights from about $4\times10^3$ to about $8\times10^4$ and in the region of molecular weights from about $1\times10^5$ to about $4\times10^6$, wherein said high molecular weight vinyl polymer component contains 97 wt % or more of styrene containing monomers as structural units for said polymer component, and having a styrene polymer with a weight average molecular weight of about 300,000 or higher, or a gel content of about 20 wt % or higher makes up 50 wt % or more of it.

2. A toner which composition comprises a toner resin composition according to claim 1.

3. The toner resin composition of claim 1, wherein said styrene polymer has a weight average molecular weight of about 400,000 or higher, or a gel content of about 30 wt % or higher.

* * * * *